US010859322B2

(12) United States Patent
Chen

(10) Patent No.: US 10,859,322 B2
(45) Date of Patent: Dec. 8, 2020

(54) COMPOSITE-TYPE HEAT TYPE

(71) Applicant: AURAS Technology Co., Ltd., New Taipei (TW)

(72) Inventor: Chih-Wei Chen, New Taipei (TW)

(73) Assignee: AURAS TECHNOLOGY CO., LTD., New Taipei (TW)

( * ) Notice: Subject to any disclaimer, the term of this patent is extended or adjusted under 35 U.S.C. 154(b) by 66 days.

(21) Appl. No.: 16/296,321

(22) Filed: Mar. 8, 2019

(65) Prior Publication Data

US 2020/0248970 A1 Aug. 6, 2020

(30) Foreign Application Priority Data

Jan. 31, 2019 (TW) ..... 108103893 A

(51) Int. Cl.
*F28D 15/00* (2006.01)
*F28D 15/04* (2006.01)
*F28D 15/02* (2006.01)

(52) U.S. Cl.
CPC ..... *F28D 15/046* (2013.01); *F28D 15/0233* (2013.01)

(58) Field of Classification Search
CPC ..... F28D 15/046; F28D 15/0233
USPC ..... 165/104.26
See application file for complete search history.

(56) References Cited

U.S. PATENT DOCUMENTS

2004/0069455 A1* 4/2004 Lindemuth ..... B22F 7/004 165/104.15
2010/0307721 A1* 12/2010 Wang ..... F28D 15/0266 165/104.26
2012/0111540 A1* 5/2012 Dai ..... B22F 3/004 165/104.26
2013/0037241 A1* 2/2013 Lin ..... F28D 15/046 165/104.26
2013/0213609 A1* 8/2013 Wu ..... F28D 15/0233 165/104.26
2018/0009073 A1* 1/2018 Chin ..... H01L 23/427

* cited by examiner

*Primary Examiner* — Davis D Hwu
(74) *Attorney, Agent, or Firm* — WPAT, PC

(57) ABSTRACT

A composite-type heat pipe includes a working fluid, a first capillary structure, a second capillary structure and a pipe body. The first capillary structure has a smooth surface. The second capillary structure has plural trenches. The pipe body accommodates the working fluid. The pipe body includes a first section and a second section. The second section is connected with the first section. The first capillary structure is formed on a first inner wall of the first section. The second capillary structure with the trenches is formed on a second inner wall of the second section. The trenches extend along an axial direction of the pipe body.

16 Claims, 8 Drawing Sheets

COMPOSITE-TYPE HEAT TYPE

FIELD OF THE INVENTION

The present invention relates to a composite-type heat pipe, and more particularly to a composite-type heat pipe with two types of capillary structures.

BACKGROUND OF THE INVENTION

Generally, a gas cooling mechanism, a liquid cooling mechanism and a heat sink made of a special material are widely used as heat dissipation mechanisms for cooling down a heat source through conduction or convection. Moreover, a heat pipe is also an effective and widely-used heat dissipation element.

The heat pipe is a hollow metal pipe with two closed ends. A proper amount of working fluid is filled in the chamber of the pipe body. The operation principles of the heat pipe are based on the two-phase change of the working fluid. A heating section is located at a first end of the pipe body. A condensation section is located at a second end of the pipe body. After the working fluid in the heating section absorbs heat from a heat source, the working fluid is transformed from a liquid state into a gaseous state. The heat is diffused within the pipe body and transferred to the condensation section. Then, the heat is exhausted through the heat exchange of an external heat dissipation mechanism.

Moreover, a capillary structure is formed on an inner wall of the pipe body. After the gaseous working fluid releases heat through heat exchange, the gaseous working fluid condenses. Consequently, the working fluid is restored from the gaseous state to the liquid state. Due to the gravity force or the capillary force, the liquid working fluid is returned to the heating section through the capillary structure. By means of the repeated two-phase (liquid/gas) cyclic change, the working fluid is continuously and circularly transferred between the heating section and the condensation section until the both ends tend to be uniform temperature. Consequently, the efficacy of continuously conducting and dissipating heat can be achieved.

However, the structure of the conventional heat pipe still has some drawbacks. For example, since the flowing directions of the liquid working state and the gaseous working fluid in the pipe body are reverse and the liquid working state and the gaseous working fluid are accommodated within the same chamber, the transferring conditions of the liquid working state and the gaseous working fluid are interfered by each other. Under this circumstance, the speed of diffusing or returning the working fluid is decreased, and the overall performance of the heat conduction and heat dissipation will be impaired.

For overcoming the above drawbacks, some approaches have been disclosed. For example, the inner wall of the pipe body is machined to create textured structures or trenches. The textured structures or trenches cooperate with the capillary structure increase the efficacy of returning the working fluid. However, this design may limit the flowing space of the gaseous working liquid within the pipe body. Especially when the diameter of the heat pipe is small, the efficacy of returning the working fluid is limited. In the subsequent production process, the heat pipe has to be further bent or pressed. Consequently, the trenches or the capillary structure on inner wall of the pipe body are possibly damaged, and the efficacy of returning the working fluid is decreased.

SUMMARY OF THE INVENTION

For overcoming the drawbacks of the conventional technologies, the present invention provides a composite-type heat pipe with two types of capillary structures. One of the capillary structures has plural trenches. The other capillary structure has a smooth surface. Due to this design, the flowing space of the gaseous working liquid is increased. Consequently, the speed of returning the liquid working fluid is increased.

In accordance with an aspect of the present invention, there is provided a composite-type heat pipe. The composite-type heat pipe includes a working fluid, a first capillary structure, a second capillary structure and a pipe body. The first capillary structure has a smooth surface. The second capillary structure has plural trenches. The pipe body accommodates the working fluid. The pipe body includes a first section and a second section. The second section is connected with the first section. The first capillary structure is formed on a first inner wall of the first section. The second capillary structure with the trenches is formed on a second inner wall of the second section. The trenches extend along an axial direction of the pipe body.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. In the following embodiments and drawings, the elements irrelevant to the concepts of the present invention are omitted and not shown.

Figure 1:
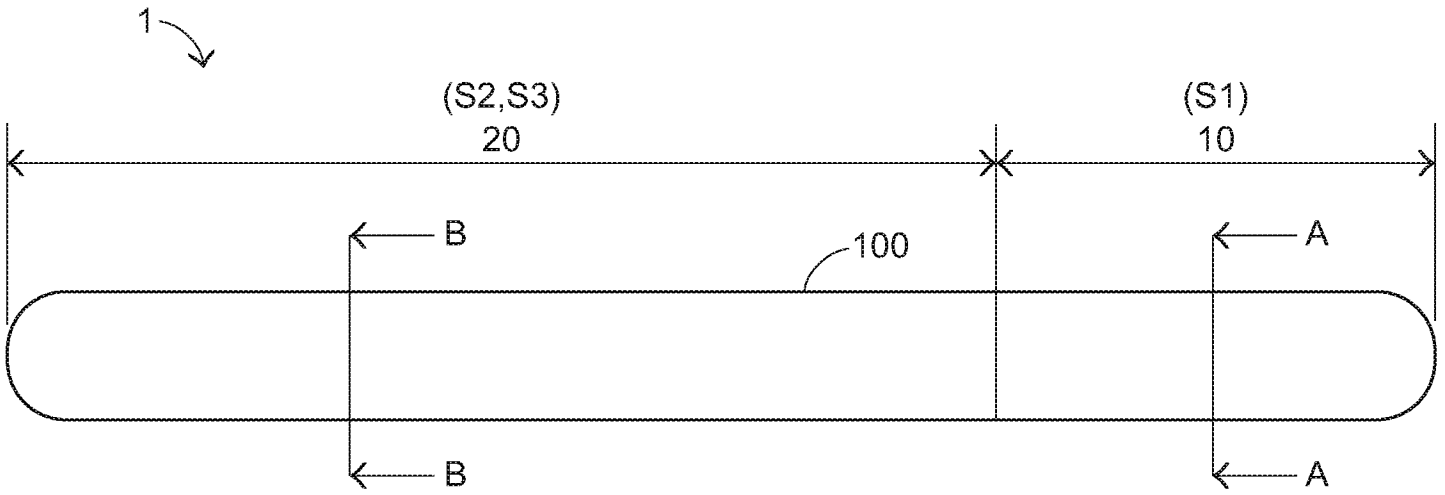
FIG. 1 is a schematic planar view illustrating the appearance of a composite-type heat pipe according to a first embodiment of the present invention.
Figure 2:
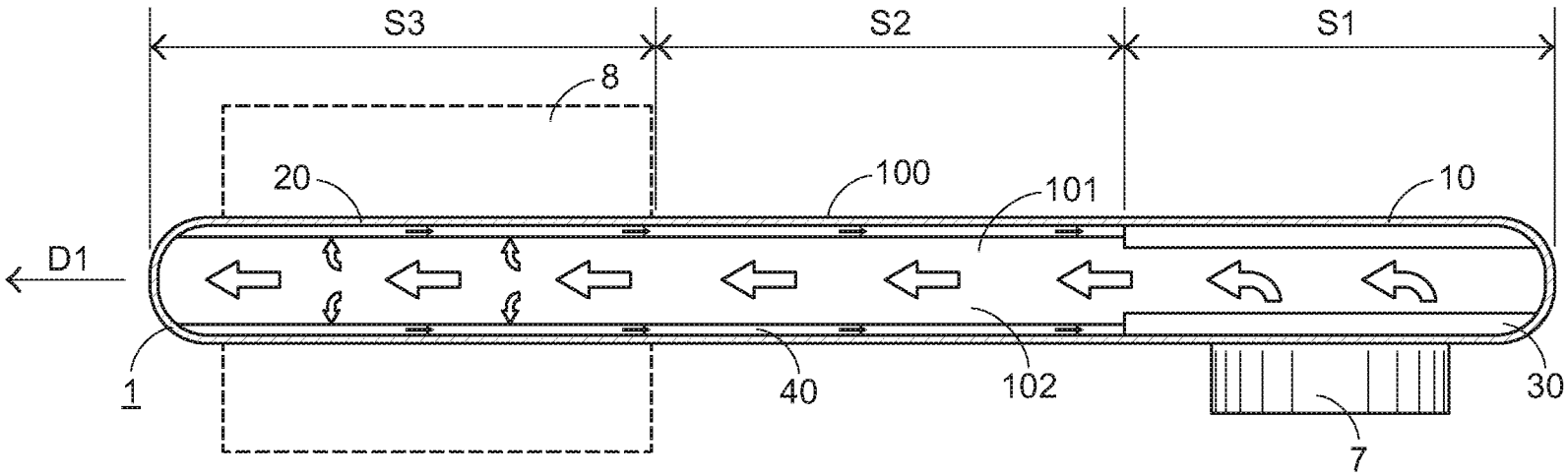
FIG. 2 is a schematic cross-sectional side view illustrating the applications of the composite-type heat pipe according to the first embodiment of the present invention.

A first embodiment of the present invention will be described as follows. Please refer to FIGS. 1 and 2. FIG. 1 is a schematic planar view illustrating the appearance of a composite-type heat pipe according to a first embodiment of the present invention. FIG. 2 is a schematic cross-sectional side view illustrating the applications of the composite-type heat pipe according to the first embodiment of the present invention. As shown in FIGS. 1 and 2, the composite-type heat pipe 1 comprises a pipe body 100 and a working fluid 102. The two ends of the pipe body 100 are closed. The working fluid 102 is accommodated within the pipe body 100. In this embodiment as shown in FIGS. 1 and 2, the pipe body 100 is a linear pipe body. It is noted that the profile of the pipe body 100 is not restricted.

For example, the working fluid 102 is water, cooling liquid or any other appropriate fluid that has the similar cooling efficacy. For example, the appropriate fluid is methanol, acetone, mercury, or the like. Before the working fluid 102 is heated, the working fluid 102 is in a liquid state. After the working fluid 102 is heated, the working fluid 102 is transformed into a gaseous state through a phase change. After the working fluid 102 is cooled, the working fluid 102 is restored into the liquid state through the phase change. Preferably, the type of the working fluid 102 is determined according to the ambient temperature. Moreover, the working fluid 102 is introduced into the pipe body 100 before the pipe body 100 is completely closed. In an operation condition, the working fluid 102 in the pipe body 100 is in a mixed state of a liquid state and a gaseous state. Moreover, the pipe body 100 is made of a metallic material with higher thermal conductivity. For example, the pipe body 100 is made of copper, aluminum or stainless steel.

Please refer to FIGS. 1 and 2 again. The pipe body 100 comprises a first section 10 and a second section 20. The second section 20 is connected with the first section 10. In this embodiment, the first section 10 includes a heating section S1. That is, the working fluid in the heating section S1 is heated by a heat source 7 (e.g., a chip unit). The second section 20 includes a condensation section S3 and a transfer section S2. The condensation section S3 cooperates with an external heat dissipation mechanism 8 (e.g., a fin-type heat sink) in order to remove the heat. In this embodiment, the heating section S1 and the condensation section S3 are located at two opposite ends of the pipe body 100, respectively. In addition, the transfer section S2 is arranged between the heating section S1 and the condensation section S3. The lengths of the heating section S1, the transfer section S2 and the condensation section S3 may be determined according to the practical requirements.

Figure 3:
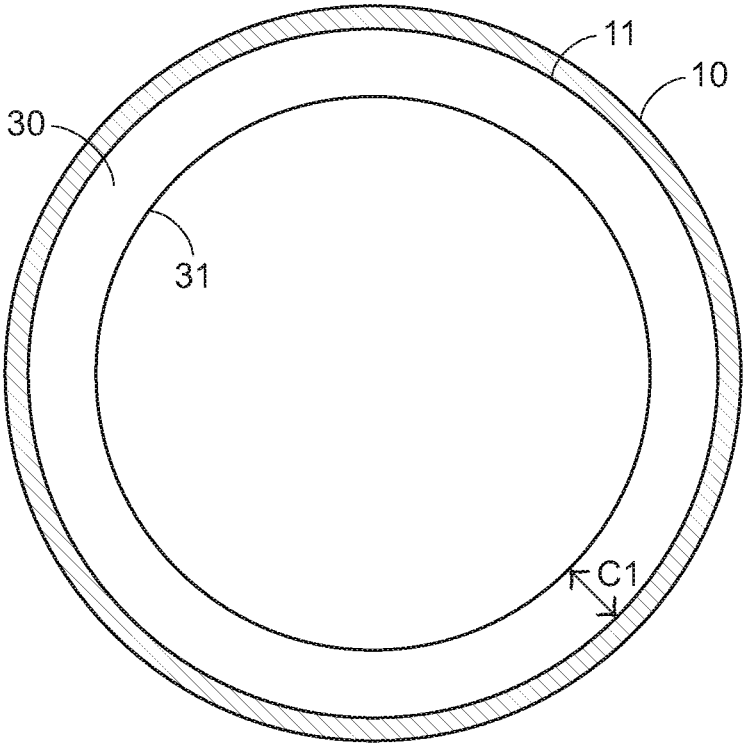
FIG. 3 is a schematic cross-sectional view illustrating the composite-type heat pipe as shown in FIG. 1 and taken along the line A-A.
Figure 4:
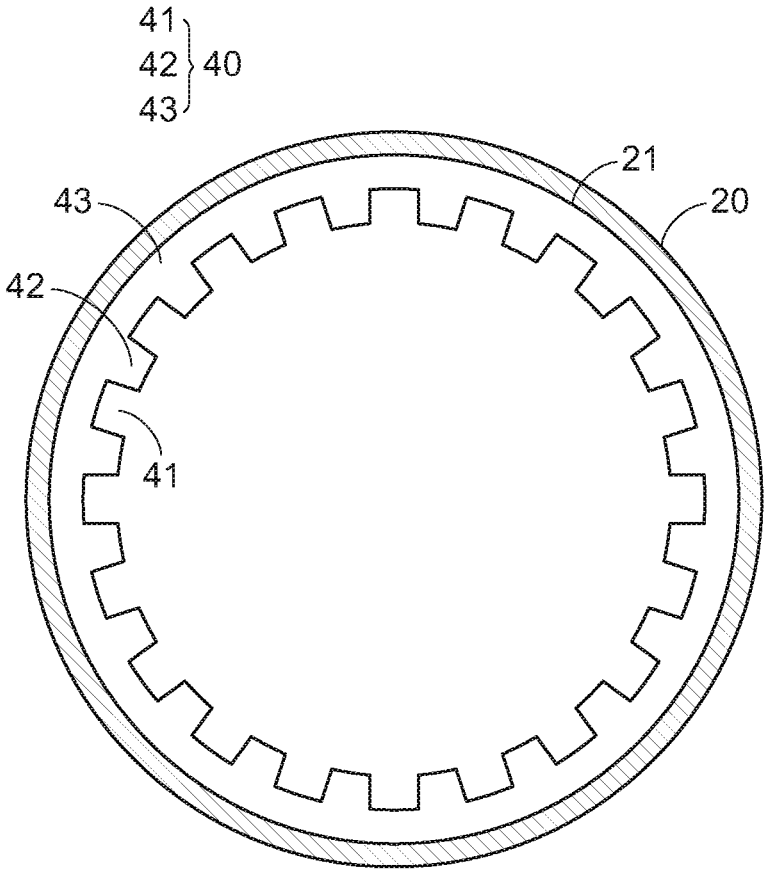
FIG. 4 is a schematic cross-sectional view illustrating the composite-type heat pipe as shown in FIG. 1 and taken along the line B-B.

Please refer to FIGS. 3 and 4. FIG. 3 is a schematic cross-sectional view illustrating the composite-type heat pipe as shown in FIG. 1 and taken along the line A-A. FIG. 4 is a schematic cross-sectional view illustrating the composite-type heat pipe as shown in FIG. 1 and taken along the line B-B. As shown in FIGS. 1, 2, 3 and 4, the composite-type heat pipe 1 further comprises a first capillary structure 30 and a second capillary structure 40. The first capillary structure 30 is included in the first section 10. The second capillary structure 40 is included in the second section 20. As shown in FIG. 3, the first section 10 has a first inner wall 11. The first capillary structure 30 is formed on the first inner wall 11. As shown in FIG. 4, the second section 20 has a second inner wall 21. The second capillary structure 40 is formed on the second inner wall 21.

Moreover, the first capillary structure 30 has a smooth surface 31. That is, when the first capillary structure 30 is formed on the first inner wall 11, the smooth surface 31 without rugged structures is exposed. In accordance with a feature of the present invention, a sufficient inner surface is retained in the first section 10 after the first capillary structure 30 is formed. That is, the first capillary structure 30 has a specified thickness, and the inner space of the first section 10 is not completely filled with the first capillary structure 30.

Please refer to FIGS. 1, 2, 3 and 4. The pipe body 100 further comprises a gas channel 101. The gas channel 101 runs through the first section 10 and the second section 20. In addition, the gas channel 101 is in communication with the heating section S1 and the condensation section S3. When the working fluid in the first capillary structure 30 is heated by the heat source 7 and transformed into the gaseous working fluid, the gas channel 101 provides a sufficient space to accommodate the gaseous working fluid.

In accordance with another feature of the present invention, the second capillary structure 40 is formed on the second inner wall 21, and the second capillary structure 40 comprises plural trenches 41. The plural trenches 41 extend along an axial direction D1. In this embodiment, the first section 10 and the second section 20 of the pipe body 100 are integrally formed. That is, the first inner wall 11 and the second inner wall 21 are integrally formed and connected with each other. However, different types of capillary structures are formed on the first inner wall 11 and the second inner wall 21.

In an embodiment, the first section 10 and the second section 20 of the pipe body 100 have the same shell thickness. Before the two ends (or one end) are closed, the first capillary structure 30 and the second capillary structure 40 are respectively formed on the first inner wall 11 and the second inner wall 21 by a proper machining process. For example, after metallic powder (e.g., copper powder) is inserted into the pipe body 100 in a sintered or metallurgical manner, the first capillary structure 30 and the second capillary structure 40 are formed.

As shown in FIG. 2, the gaseous working fluid 102 flows along the direction indicated by the hollow arrows. The capillary structures 30 and 40 made of the copper powder are attached on the inner walls 11 and 12 of the pipe body 100, respectively. After the gaseous working fluid 102 is condensed and transformed into the liquid working fluid 102 in the condensation section S3 through the phase change, the liquid working fluid 102 is adsorbed by the second capillary structure 40 and the first capillary structure 30. Consequently, the liquid working fluid 102 is returned to the heating section S1 (I.e., the first section 10) through the second capillary structure 40 and the first capillary structure 30 along the direction indicated by solid arrows.

In this embodiment, the axial direction D1 is the direction of the centerline of the pipe body 100. The trenches 41 extend along the axial direction D1. That is, the trenches 41 from an end to another end of the second section 20 are parallel with the axial direction D1. It is noted that the arrangement of the trenches 41 is not restricted to the parallel arrangement. As long as the liquid working fluid 102 can be returned to the heating section 10 through the trenches 41, the arrangement of the trenches 41 is not restricted.

As shown in FIG. 4, the plural trenches 41 are discretely arranged in a regular zigzag pattern. That is, the plural trenches 41 are grooves that are spaced apart. In this embodiment, the second capillary structure 40 further comprises plural protrusion structures 42 and a base portion 43. Each trench 41 is arranged between two adjacent protrusion structures 42. The plural protrusion structures 42 and the plural trenches 41 are collaboratively formed as plural rectangular saw-toothed structures. Due to the arrangement of the plural trenches 41, the circumference of the second capillary structure 40 is longer than the circumference of the capillary structure with the smooth surface (e.g., the first capillary structure 30 with the smooth surface 31). Since the contact area is increased, the second capillary structure 40 is effective to increase the speed of returning the liquid working fluid.

As mentioned above, the increased contact area of the capillary structure can increase the speed of returning the liquid working fluid. Moreover, since the liquid working fluid is effectively adsorbed by the increased contact area of the capillary structure, the problems (e.g., noisy sound) caused by the overflowing condition of the general heat pipe will be overcome. Since the problems caused by the overflowing condition are largely reduced, the heat pipe can be applied to a low-temperature environment (e.g., in the polar region at minus 40 degrees Celsius). When the heat pipe is used in the low-temperature environment, the icing problem caused by the overflowing condition is effectively solved. Consequently, the damage of the pipe structure caused by the icing problem on will be avoided.

In accordance with the present invention, the second capillary structure 40 with the trenches 41 are directly formed on the second inner wall 21. That is, the second inner 21 is not machined to create textured structures or trenches before the capillary structure is sintered. Consequently, the limitation on the flowing space of the gaseous working liquid 102 within the pipe body 100 is reduced. In other words, the gas channel 101 is lager.

Figure 5:
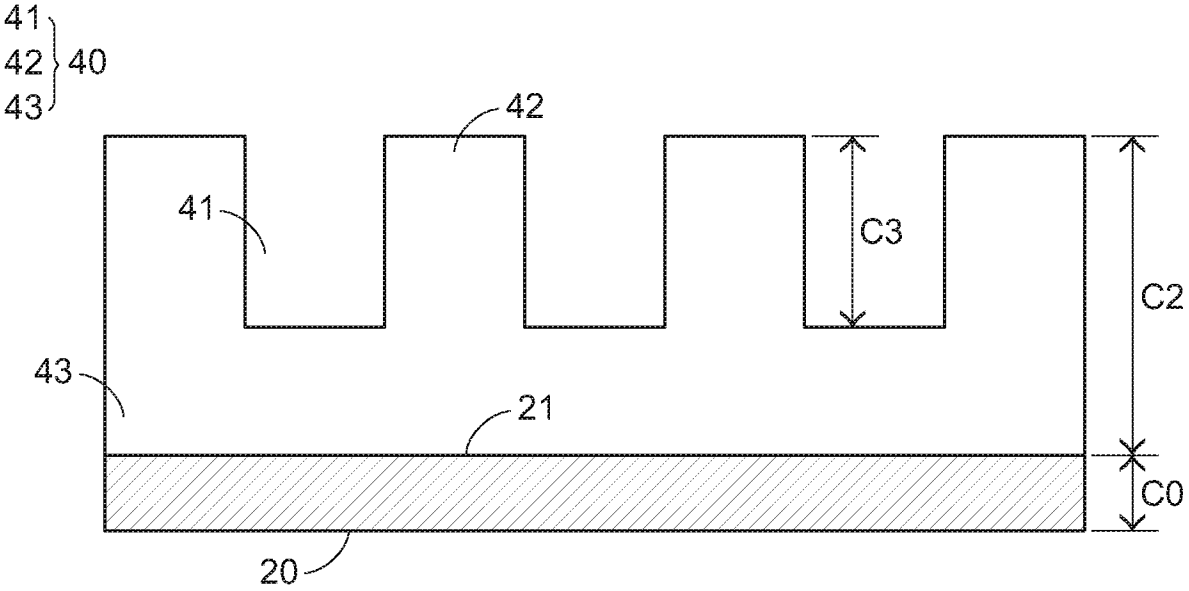
FIG. 5 is a schematic enlarged cross-sectional view illustrating portions of the second section and the second capillary structure of the composite-type heat pipe as shown in FIG. 1.

FIG. 5 is a schematic enlarged cross-sectional view illustrating portions of the second section and the second capillary structure composite-type heat pipe as shown in FIG. 1. As shown in FIG. 5, the pipe body 100 in the second section 20 has a shell thickness C0, and the second capillary structure 40 has a second thickness C2. Generally, as the depth of the trench is increased, the efficacy of returning the working fluid is increased. Consequently, in this embodiment, the second thickness C2 is larger than the shell thickness C0, and the second capillary structure 40 has a second thickness C2. As mentioned above, the second capillary structure 40 comprises the plural trenches 41, the plural protrusion structures 42 and the base portion 43. Consequently, the depth C3 of the trench 41 (or the height of the protrusion structure 42) plus the thickness of the base portion 43 is equal to the second thickness C2.

In a simulation experiment, the shell thickness C0 is in the range between 0.1 mm and 0.4 mm, and the second thickness C2 is in the range between 0.3 mm and 1.5 mm. Moreover, the depth C3 of the trench 41 (or the height of the protrusion structure 42) is in the range between 0.3 mm and 0.5 mm. That is, the maximum thickness of the base portion 43 is 1.2 mm. In case that the second thickness C2 is 0.3 mm and the depth C3 is 0.3 mm, it means that the base portion 43 is omitted.

The first capillary structure 30 has a first thickness C1. The first thickness C1 may be correlated with or not correlated with the second thickness C2. That is, the first thickness C1 is smaller than, equal to or larger than the second thickness C2. For providing a sufficient space to accommodate the gaseous working fluid 102, the first thickness C1 is not too large. However, since the temperature of the heating section S1 is relatively higher, it is necessary to retain sufficient liquid working fluid 102. In other words, the first thickness C1 is not too small. In a simulation experiment, the first thickness C1 is in the range between 0.3 mm and 2.5 mm.

It is noted that numerous modifications and alterations may be made while retaining the teachings of the invention.

For example, in a variant example, the first capillary structure in the first section and the second capillary structure in the second section are separately produced and then combined together. That is, the first section and the second section of the pipe body are not integrally formed, and the first capillary structure and the second capillary structure are not integrally formed. In this case, the first inner wall and the second inner wall may have different shell thicknesses. This design is suitably applied to the large-sized heat pipe module because the distance between the heat source and the heat dissipation system is long.

Alternatively, the shapes of the trenches of the second capillary structure may be varied or adjusted according to the practical requirements.

Figure 6:
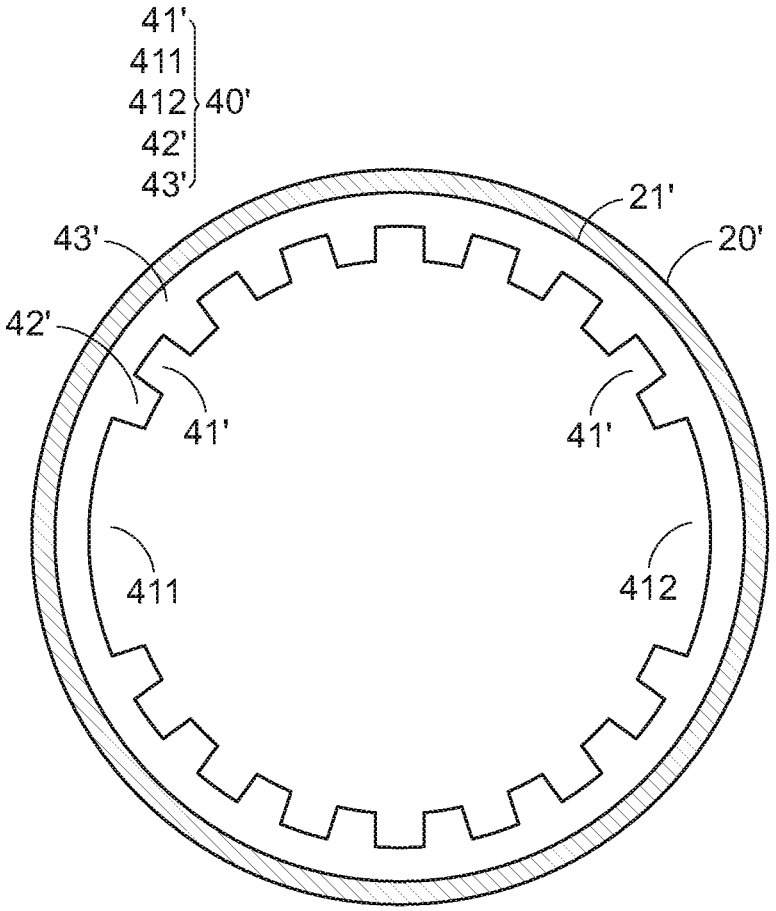
FIG. 6 is a schematic cross-sectional view illustrating a second section of a composite-type heat pipe according to second embodiment of the present invention.

A second embodiment of the present invention will be described as follows. FIG. 6 is a schematic cross-sectional view illustrating a second section of a composite-type heat pipe according to second embodiment of the present invention. Component parts and elements corresponding to those of the first embodiment are designated by similar numeral references. In this embodiment, the second capillary structure 40' comprises plural trenches 41', plural protrusion structures 42' and a base portion 43'. In comparison with the first embodiment, the trenches 41', 411 and 412 of the second capillary structure 40 formed on the second inner wall 21' of the second section 20' are not equidistant or irregularly arranged.

Similarly, the plural trenches 41', 411 and 412 are arranged in a regular zigzag pattern. That is, the plural trenches 41', 411 and 412 are grooves that are spaced apart. However, the trenches 411 and 412 are wider than the trenches 41'. That is, the trenches except for the trenches 411 and 412 are narrow. As previously described, the heat pipe has to be further processed (e.g., bent or pressed) in the subsequent production process. In case that the regions corresponding to wider trenches (e.g., the trenches 411 and 412 as shown in FIG. 6) are processed, the possibility of causing deformation or damage of the trenches or the capillary structure will be minimized.

In the second embodiment, two trenches have the larger widths. It is noted that the number of the wider trenches is not restricted. That is, the second capillary structure may comprise more than two wider trenches or at least one wider trench.

Alternatively, the relationships between the first section (and the second section) and the condensation section, the transfer section and the heating section are not restricted. In the first embodiment, the portion of the first section 10 corresponding to the smooth surface 31 is used as the heating section S1, and the portion of the second section 20 corresponding to the trenches 41 is used as the condensation section S3 and the transfer section S2. However, the structure of the transfer section is not restricted.

Figure 7:
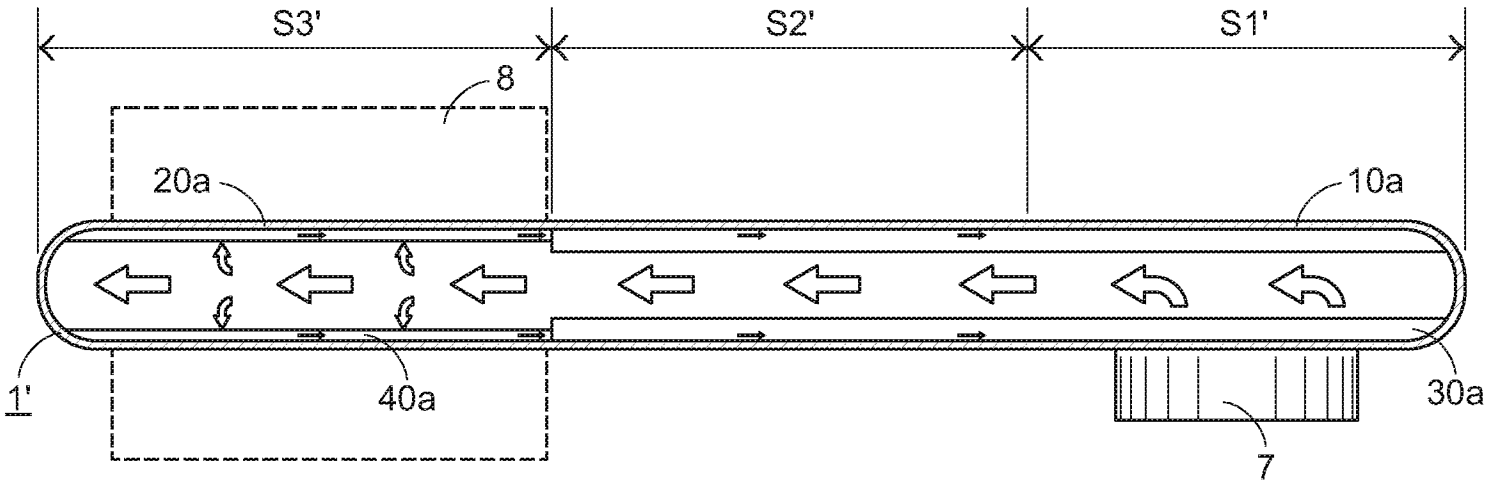
FIG. 7 is a schematic cross-sectional side view illustrating the applications of a composite-type heat pipe according to a third embodiment of the present invention.

A third embodiment of the present invention will be described as follows. FIG. 7 is a schematic cross-sectional side view illustrating the applications of a composite-type heat pipe according to a third embodiment of the present invention. Component parts and elements corresponding to those of the first embodiment are designated by similar numeral references. In comparison with the first embodiment, the second section 20*a* with the second capillary structure 40*a* (i.e., the corresponding trenches) is used as the condensation section S3' only. In addition, the first section 10*a* with the first capillary structure 30*a* (i.e., the corresponding smooth surface) is used as the heating section S1' and the transfer section S2'.

Figure 8:
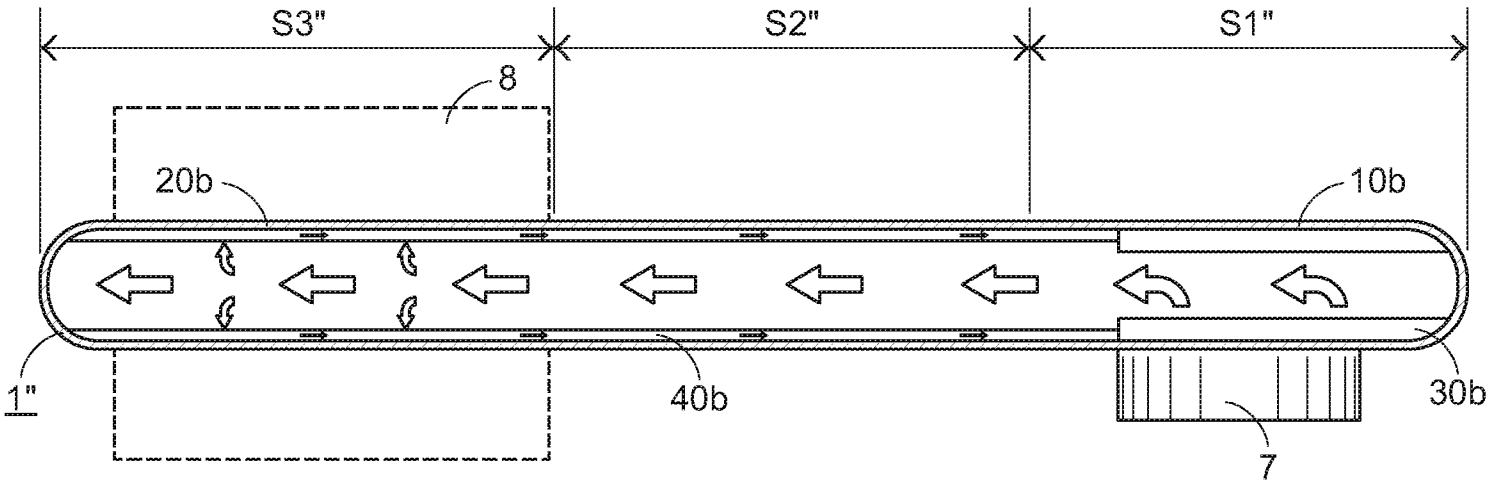
FIG. 8 is a schematic cross-sectional side view illustrating the applications of a composite-type heat pipe according to a fourth embodiment of the present invention.

A fourth embodiment of the present invention will be described as follows. FIG. 8 is a schematic cross-sectional side view illustrating the applications of a composite-type heat pipe according to a fourth embodiment of the present invention. Component parts and elements corresponding to those of the first embodiment are designated by similar numeral references. In comparison with the first embodiment, the first section 10*b* with the first capillary structure 30*b* (i.e., the corresponding smooth surface) is used as a portion of the heating section S1". In addition, the second section 20*b* with the second capillary structure 40*b* (i.e., the corresponding trenches) is used as the condensation section S3", the transfer section S2" and another portion of the heating section S1". In this embodiment, the second section 20*b* (or the second capillary structure 40*b*) is not overlapped with the heat source 7. That is, an edge of the second section 20*b* (or the second capillary structure 40*b*) is aligned with an edge of the heat source 7, and the second section 20*b* is not located over the heat source 7.

From the above descriptions, the composite-type heat pipe of the present invention is advantageous over the conventional technologies because of the following benefits. Firstly, since the capillary structure is formed on the corresponding inner wall of the pipe body and the trenches of the capillary structure are contacted with the gaseous working fluid, the flowing space of the gaseous working liquid within the pipe body is increased. Secondly, the trenches in the capillary structure increase the contact area. Consequently, the speed of returning the liquid working fluid is increased. Thirdly, since the speed of returning the liquid working fluid is increased, the problems (e.g., or noisy sound) caused by the overflowing condition of the general heat pipe will be overcome. Fourthly, since the problems caused by the overflowing condition are largely reduced, the heat pipe can be applied to a low-temperature environment. When the heat pipe is used in the low-temperature environment, the damage of the pipe structure caused by the icing problem on will be avoided. Fifthly, the gas channel is retained in the inner space of the heating section. When the working fluid is vaporized into the gaseous state, the gas channel has the sufficient space for accommodating the gaseous working fluid.

In other words, the technologies of the present invention can overcome the drawbacks of the conventional technologies while achieving the objects of the present invention.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A composite-type heat pipe, comprising:

a working fluid;

a first capillary structure having a smooth surface;

a second capillary structure having plural trenches; and a pipe body accommodating the working fluid, wherein the pipe body comprises a first section and a second section, and the second section is connected with the first section, wherein the first capillary structure is formed on a first inner wall of the first section, the second capillary structure with the trenches is formed on a second inner wall of the second section, the trenches extend along an axial direction of the pipe body, and the second section comprises a condensation section corresponding to a heat dissipation mechanism to remove heat.

2. The composite-type heat pipe according to claim 1, wherein the pipe body has a shell thickness, and the second capillary structure has a second thickness, wherein the second thickness is larger than the shell thickness.

3. The composite-type heat pipe according to claim 2, wherein the shell thickness is in a range between 0.1 mm and 0.4 mm.

4. The composite-type heat pipe according to claim 2, wherein the second thickness is in a range between 0.3 mm and 1.5 mm.

5. The composite-type heat pipe according to claim 2, wherein the first capillary structure has a first thickness, wherein the first thickness is larger than the second thickness.

6. The composite-type heat pipe according to claim 5, wherein the first thickness is in a range between 0.3 mm and 2.5 mm.

7. The composite-type heat pipe according to claim 2, wherein the first capillary structure has a first thickness, wherein the first thickness is smaller than or equal to the second thickness.

8. The composite-type heat pipe according to claim 1, wherein the plural trenches are discretely arranged in a regular pattern.

9. The composite-type heat pipe according to claim 1, wherein the plural trenches are discretely arranged in an irregular pattern, and at least one trench of the plural trenches is wider than an adjacent trench.

10. The composite-type heat pipe according to claim 1, wherein the first section is a heating section, and the heating section corresponds to a heat source to heat the working fluid.

11. The composite-type heat pipe according to claim 10, wherein the second section comprises:

a condensation section corresponding to a heat dissipation mechanism to remove heat; and a transfer section arranged between the heating section and the condensation section.

12. The composite-type heat pipe according to claim 1, wherein the first section comprises:

a heating section corresponding to a heat source to heat the working fluid; and a transfer section arranged between the heating section and the condensation section.

13. The composite-type heat pipe according to claim 1, wherein the first section is a first portion of a heating section, the heating section corresponds to a heat source to heat the working fluid.

14. The composite-type heat pipe according to claim 13, wherein the second section comprises:

a condensation section corresponding to a heat dissipation mechanism to remove heat;

a transfer section arranged between the heating section and the condensation section; and a second portion of the heating section, wherein the second section is not overlapped over the heat source.

15. The composite-type heat pipe according to claim 1, wherein the pipe body further comprises a gas channel, wherein the gas channel runs through the first section and the second section.

16. The composite-type heat pipe according to claim 1, wherein the first capillary structure and the second capillary structure are formed by processing a metallic powder in a sintered or metallurgical manner, wherein the metallic powder is copper powder.

* * * * *